US011390099B2

(12) United States Patent
Emoto et al.

(10) Patent No.: US 11,390,099 B2
(45) Date of Patent: Jul. 19, 2022

(54) INKJET PRINTING APPARATUS AND CLEANING METHOD

(71) Applicant: CANON KABUSHIKI KAISHA, Tokyo (JP)

(72) Inventors: Yuki Emoto, Tokyo (JP); Keisuke Arita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/170,594

(22) Filed: Feb. 8, 2021

(65) Prior Publication Data

US 2021/0252889 A1 Aug. 19, 2021

(30) Foreign Application Priority Data

Feb. 19, 2020 (JP) ..... JP2020-026161

(51) Int. Cl.
*B41J 29/17* (2006.01)
*B41J 11/00* (2006.01)
*B41J 11/42* (2006.01)

(52) U.S. Cl.
CPC ..... *B41J 29/17* (2013.01); *B41J 11/0095* (2013.01); *B41J 11/42* (2013.01)

(58) Field of Classification Search
CPC ..... B41J 29/17; B41J 11/0095; B41J 11/46
See application file for complete search history.

(56) References Cited

U.S. PATENT DOCUMENTS 8,864,269 B2 10/2014 Suzuki ..... B41J 29/17
2013/0033537 A1* 2/2013 Suzuki ..... B41J 29/17 347/16

FOREIGN PATENT DOCUMENTS

JP 2013-035628 2/2013

* cited by examiner

*Primary Examiner* — Scott A Richmond
(74) *Attorney, Agent, or Firm* — Venable LLP

(57) ABSTRACT

Provided is an inkjet printing apparatus capable of wiping off contamination on a platen efficiently. To that end, a cleaning sheet in which a first crease and a second crease are formed is conveyed to clean the platen in the printing apparatus. In this operation, the conveyance of the cleaning sheet is controlled so that the cleaning sheet moves back and forth with the first crease of the cleaning sheet being in contact with a first region of the platen. Further, the conveyance of the cleaning sheet is controlled so that the cleaning sheet moves back and forth with the second crease of the cleaning sheet being in contact with a second region of the platen, the second region being at a position different from the first region in the conveyance direction.

7 Claims, 13 Drawing Sheets

INKJET PRINTING APPARATUS AND CLEANING METHOD

BACKGROUND OF THE INVENTION

Field of the Invention

The present invention relates to an inkjet printing apparatus and a cleaning method.

Description of the Related Art

An inkjet printing apparatus prints an image on a printing medium by ejecting ink from a printing head according to image data. During this ejection operation by the printing head, minute droplets may also be generated, which become a mist, floating and adhering to the inside of the apparatus. In particular, adhesion of such a mist to the surface of a platen that supports a printing medium being printed may contaminate a printing medium to be printed next.

Japanese Patent Laid-Open No. 2013-35628 discloses a method in which a cleaning sheet having a crease is conveyed in the same convenance path as a printing medium to wipe the surface of a platen with the vertex of the crease of the cleaning sheet and thereby remove ink therefrom.

However, there are cases where even the platen cleaning using the method described in Japanese Patent Laid-Open No. 2013-35628 cannot satisfactorily wipe off the ink adhering to the platen. It is possible to repeat the cleaning by conveying a new cleaning sheet until a satisfactory cleaning effect is achieved, but then the cleaning would take a great amount of time.

SUMMARY OF THE INVENTION

The present invention has been made to solve the above-described problem, and has an object to provide an inkjet printing apparatus capable of wiping off contamination on a platen efficiently.

In a first aspect of the present invention, there is provided printing apparatus comprising: a conveyance unit capable of conveying a printing medium in a conveyance direction; a printing head configured to eject ink toward a printing medium that is conveyed by the conveyance unit; a platen having a first region and a second region at different positions in the conveyance direction, facing the printing head and configured to support a printing medium; and a control unit configured to, in a case of cleaning the platen, cause the conveyance unit to move a cleaning sheet in which a first crease and a second crease are formed back and forth in the conveyance direction so that the first crease contacts the first region and the second crease contacts the second region.

In a second aspect of the present invention, there is provided a cleaning method for cleaning a platen in an inkjet printing apparatus that includes a conveyance unit capable of conveying a printing medium in a conveyance direction; a printing head configured to eject ink toward a printing medium that is conveyed by the conveyance unit; and a platen having a first region and a second region at different positions in the conveyance direction, facing the printing head and configured to support a printing medium, the cleaning method comprising causing, in a case of cleaning the platen, the conveyance unit to move a cleaning sheet in which a first crease and a second crease are formed back and forth in the conveyance direction so that the first crease contacts the first region and the second crease contacts the second region.

Further features of the present invention will become apparent from the following description of exemplary embodiments with reference to the attached drawings.

DESCRIPTION OF THE EMBODIMENTS

First Embodiment

Figure 1:
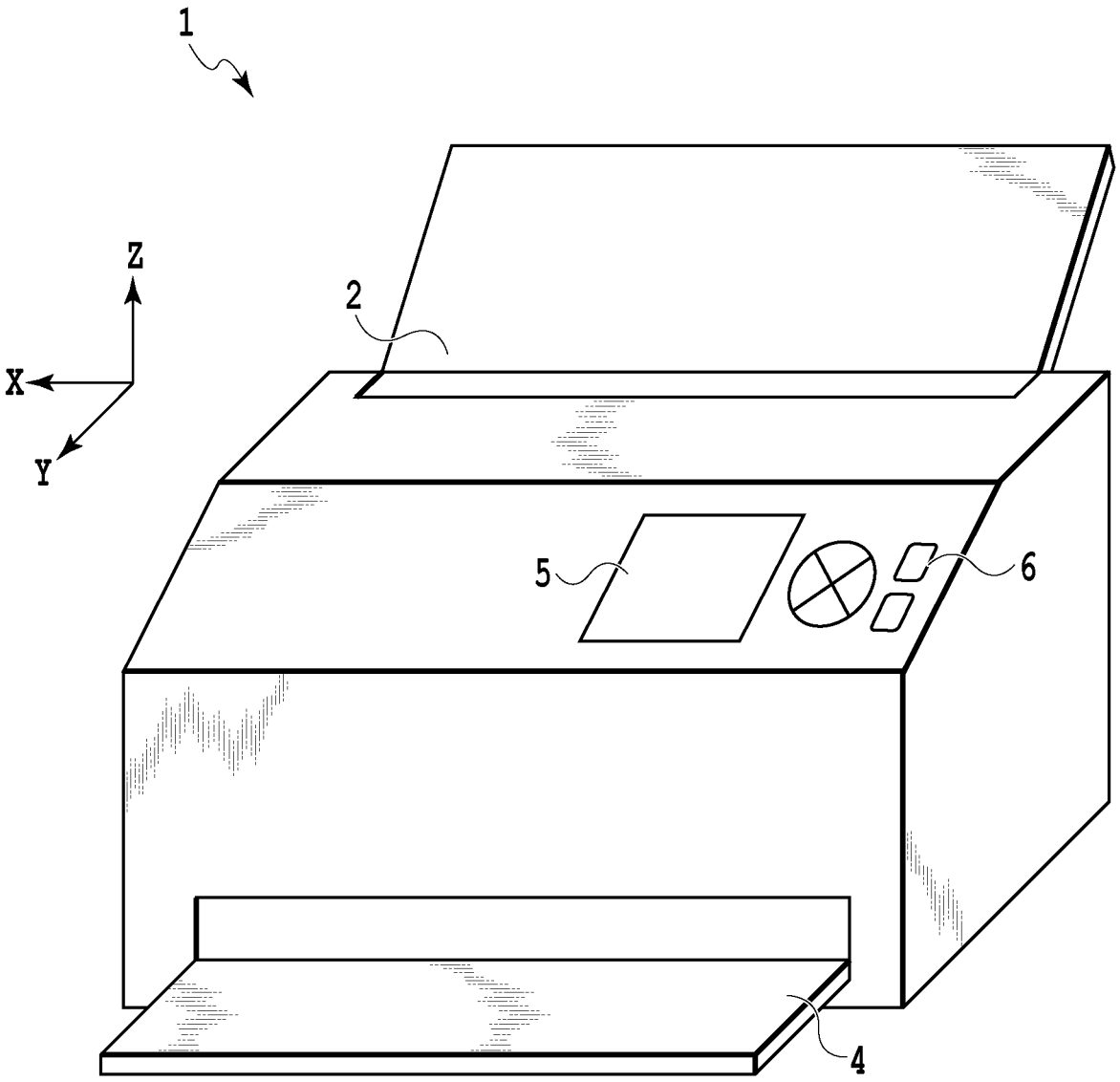
FIG. 1 is a diagram showing the outer appearance of an inkjet printing apparatus.

FIG. 1 is a diagram showing the outer appearance of an inkjet printing apparatus (hereinafter also referred to simply as a printing apparatus) 1 used in a first embodiment. The printing apparatus 1 includes a paper feed unit 2 that feeds a printing medium having no image printed thereon and a paper discharge unit 4 that discharges a printing medium having an image printed thereon. Placed on the front side of the main body of the printing apparatus 1 are a display panel 5 for presenting information to a user and operation keys 6 capable of receiving an instruction from a user. The display panel 5 and the operation keys 6 may be formed integrally as a touch panel.

In the following description, the X direction is the width direction of a printing medium, the Y direction is the direction in which a printing medium is conveyed in a printing unit, and the Z direction is a vertically upward direction.

Figure 2:
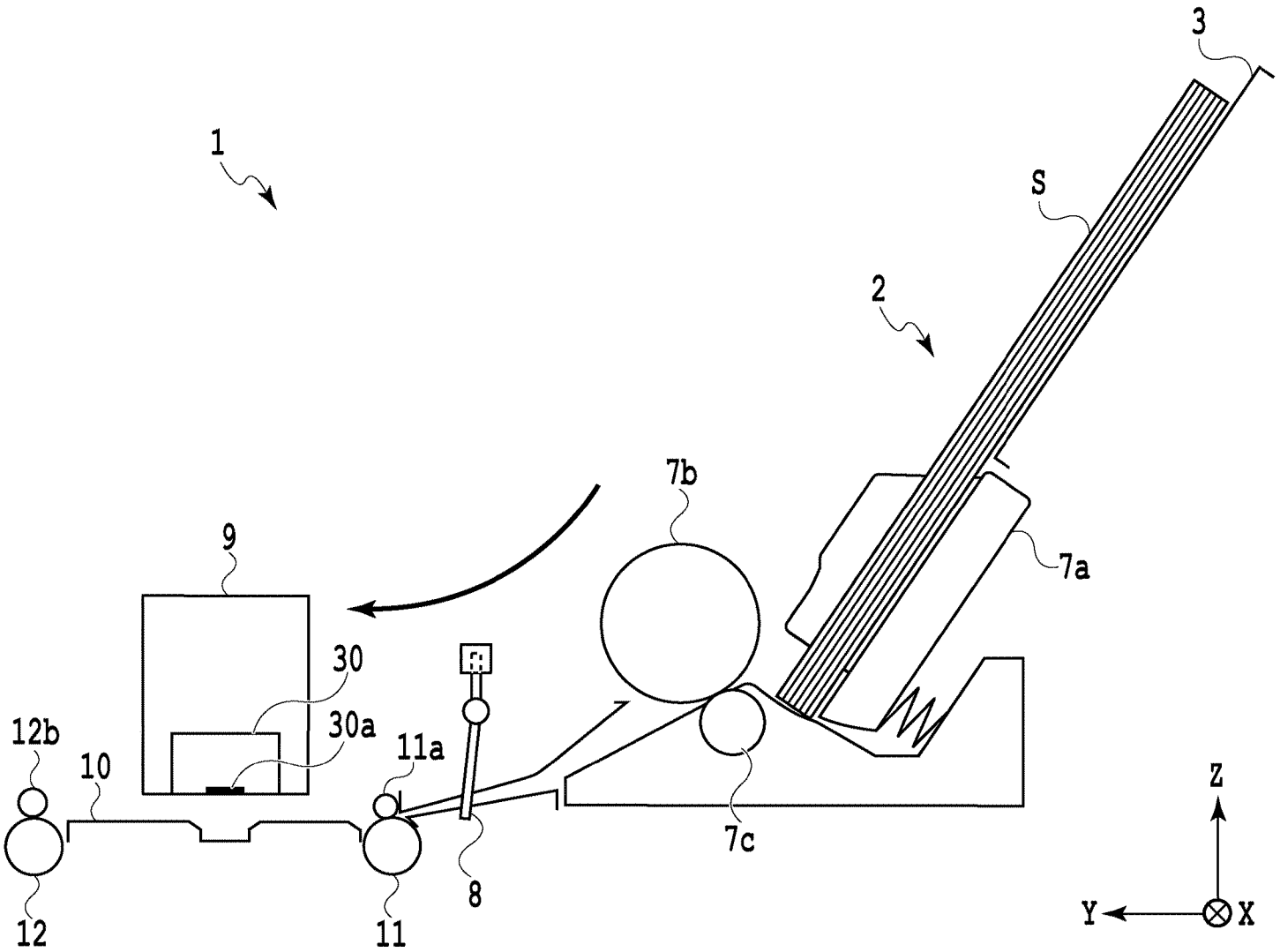
FIG. 2 is a diagram showing a schematic configuration of a printing unit.

FIG. 2 is a diagram showing a schematic configuration of the printing unit. In the paper feed unit 2, a printing medium S before printing is placed on a paper feed tray 3 in a stacking manner. A pressure plate 7*a* supports the printing medium S placed on the paper feed tray 3 from the back. To perform a printing operation, the pressure plate 7*a* is raised, bringing the uppermost one of the printing media S placed on the paper feed tray 3 into contact with a paper feed roller 7*b*. Then, as the paper feed roller 7*b* rotates, the printing medium S is fed in the direction indicated by the arrow. In this event, the printing media S other than the uppermost one is separated from the uppermost printing medium S by a separation roller 7*c* and brought back to the paper feed tray 3.

An edge sensor 8 is placed on the conveyance path. The edge sensor 8 can detect passage of the leading edge and the tailing edge of the printing medium S as the printing medium S being conveyed comes into contact with and turns the lever of the edge sensor 8.

Downstream of the edge sensor 8 in the conveyance path, there are placed a roller pair formed by an upstream roller 11 and pinch rollers 11*a* and a roller pair formed by a downstream roller 12 and spurs 12*a*. Between these two roller pairs, a platen 10 that supports the printing medium S from below is placed. A carriage 9 which is movable in the ±X directions is placed above the platen 10 in the Z direction, facing the platen 10. The distance from the area of the printing medium S nipped by the two roller pairs and supported on the platen 10 to an ejection port surface 30*a* of a printing head 30 mounted in the carriage 9 is maintained within a certain range.

Figure 3:
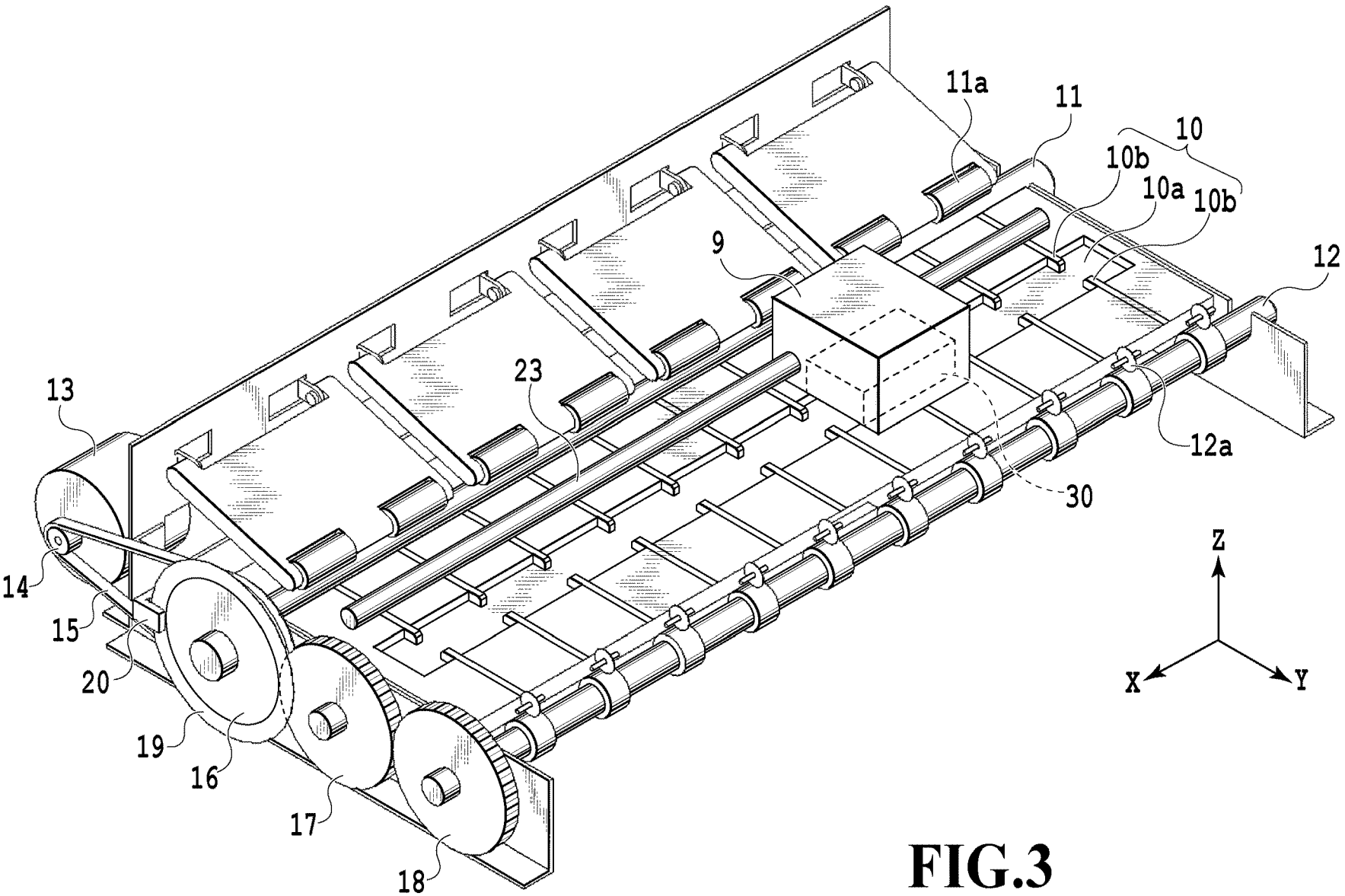
FIG. 3 is a perspective view illustrating the structure of the printing unit of the printing apparatus.

FIG. 3 is a perspective view illustrating the structure of the printing unit of the printing apparatus 1. The upstream roller 11 and the downstream roller 12 are drive rollers driven by a conveyance motor 13. The upstream roller 11 rotates by receiving the drive force of the conveyance motor 13 transmitted through a drive motor pully 14, a timing belt 15, and a pully gear 16. The downstream roller 12 rotates by receiving the drive force of the conveyance motor 13 transmitted through the drive motor pully 14, the timing belt 15, the pully gear 16, an idler gear 17, and a downstream roller gear 18. The upstream roller 11 and the downstream roller 12 can be rotated reversely by switching of the rotation direction of the conveyance motor 13 which is a DC motor.

A cord wheel 19 is placed coaxially with the upstream roller 11. A plurality of slits are formed in the cord wheel 19 at a predetermined pitch. An encoder sensor 20 provided on a part of the rotating path of the cord wheel 19 detects passage of the slits in the cord wheel 19, and thereby a controller 205 (see FIG. 4) can detect how much and where the printing medium S has been conveyed. Although the cord wheel 19 is placed coaxially with the upstream roller 11 here, the cord wheel 19 may be attached to a different member driven by the conveyance motor 13.

The carriage 9 equipped with the printing head 30 can move in the ±X directions while being guided and supported by a guide shaft 23. While the carriage 9 is moving, the printing head 30 ejects ink toward the printing medium S (not shown in FIG. 3) supported on the platen 10 according to ejection data, thereby printing a band of an image on the printing medium S. By alternately repeating this printing scan to print one band of an image and a conveyance operation to convey the printing medium S in the Y direction by a distance corresponding to one band, an image is gradually formed on the printing medium S.

In the printing apparatus 1 of the present embodiment, the platen 10 has a groove portion 10*a* extending in the X direction which intersects with the conveying direction. The groove portion 10*a* collects ink that lands outside the leading and tailing edges or the left and right edges of the printing medium S in a "borderless printing" mode. In a region other than the groove portion 10*a*, a plurality of ribs 10*b* are placed to keep the printing medium S from waving. A detailed description will be given later for the configuration of the platen 10.

Figure 4:
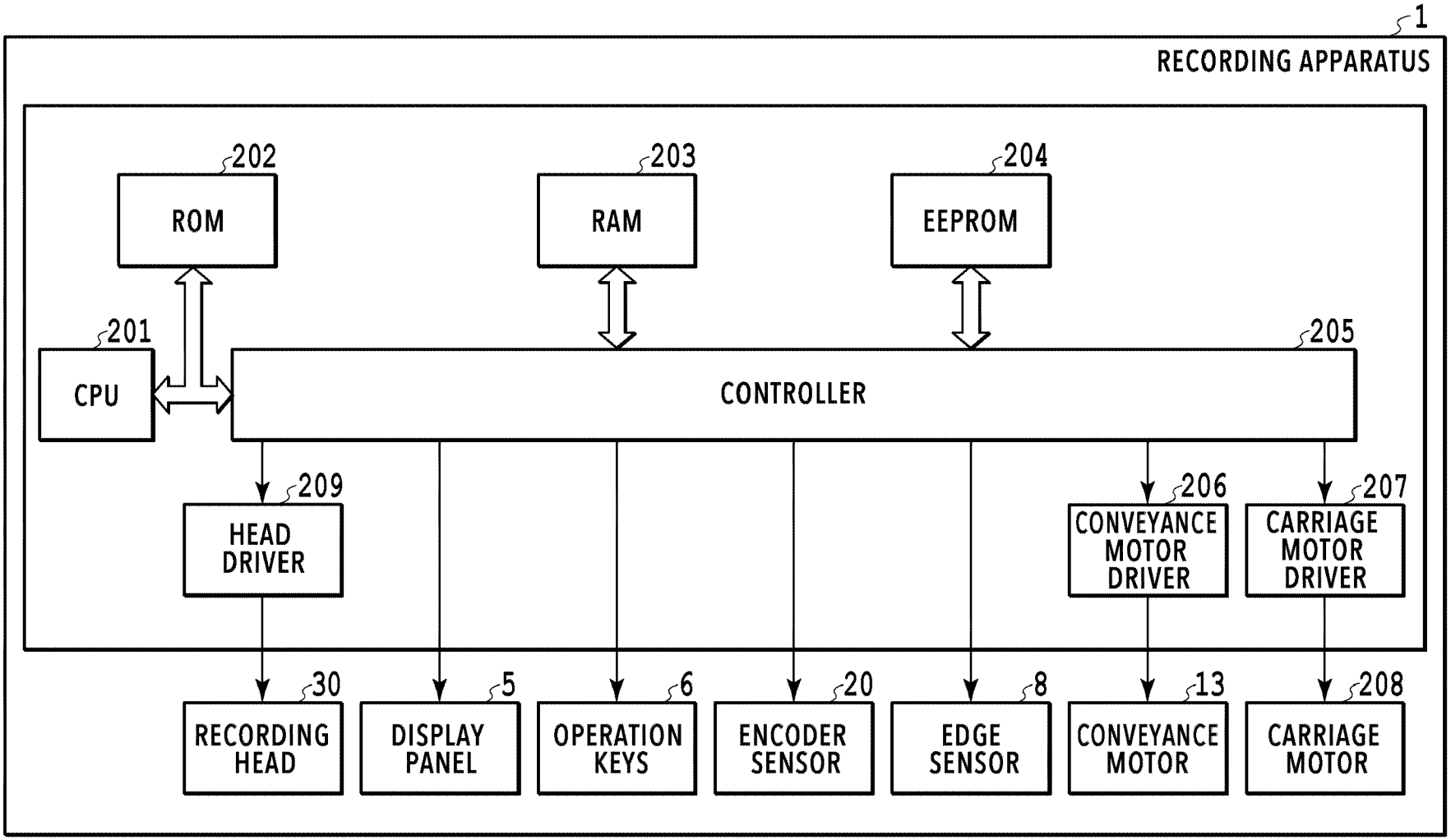
FIG. 4 is a block diagram illustrating the control configuration of the printing apparatus.

FIG. 4 is a block diagram illustrating the control configuration of the inkjet printing apparatus 1. A CPU 201 causes the controller 205 to perform overall control of the apparatus according to the programs stored in a ROM 202. The controller 205 controls each mechanism as instructed by the CPU 201, using a RAM 203 as a work area. An EEPROM 204 holds, in a rewritable manner, parameters needed for the controller 205 to control the printing apparatus 1.

A conveyance motor driver 206 is a driver for driving the conveyance motor 13. The controller 205 drives the conveyance motor 13 through the conveyance motor driver 206, thereby controlling the rotation of the upstream roller 11 and the downstream roller 12, and in turn, the conveyance of the printing medium S. A carriage motor driver 207 is a driver for driving a carriage motor 208. A head driver 209 is a driver for driving the printing head 30.

Figure 5B:
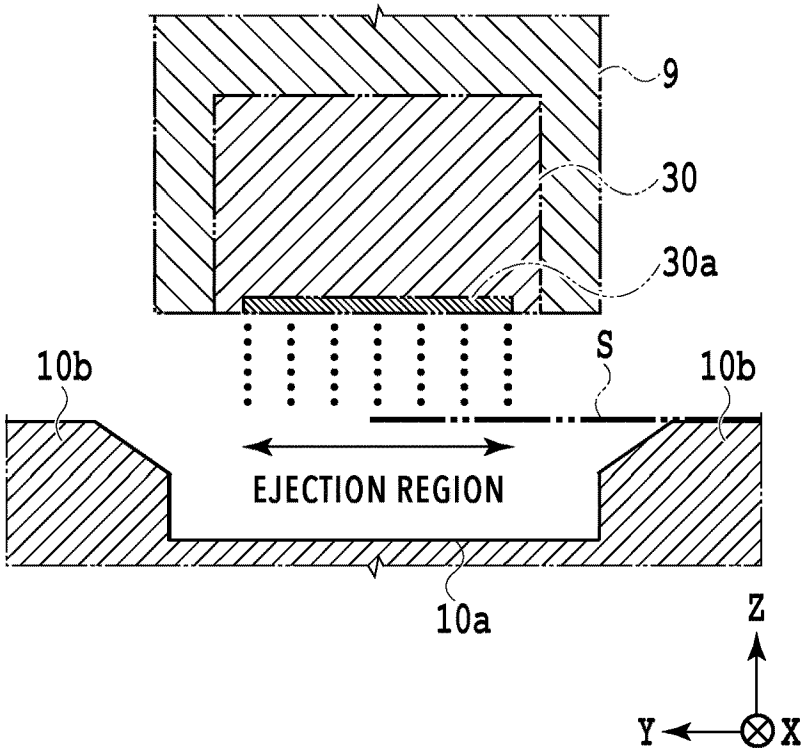
FIGS. 5A and 5B are diagrams illustrating the configuration of a platen in detail.
Figure 5A:
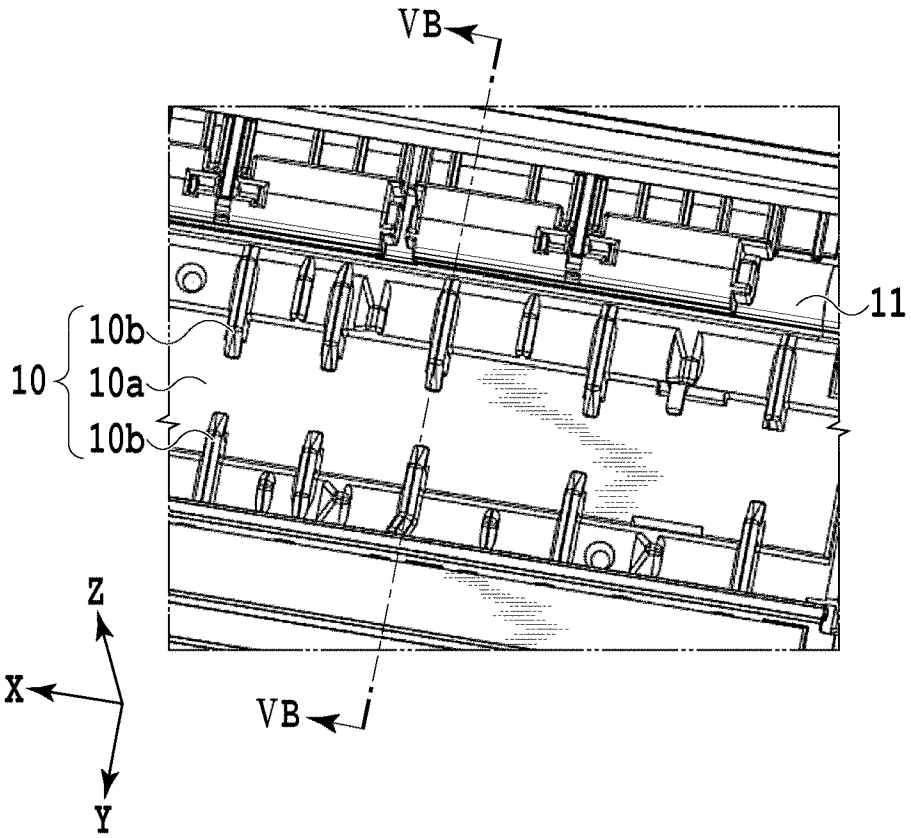

FIGS. 5A and 5B are diagrams illustrating the configuration of the platen 10 in detail. FIG. 5A is a top view, and FIG. 5B is a sectional view taken along two ribs 10*b* facing each other. Although FIG. 5A does not show the printing medium S, FIG. 5B shows the printing head 30 printing an image on a leading edge part of the printing medium S.

The groove portion 10*a* is a space for collecting ink ejected outside the printing medium S. The width of the groove portion 10*a* in the conveyance direction (the Y direction) is larger than the ejection region of the printing head 30, so that ink ejected from the printing head 30 can be collected in the groove portion 10*a*. Optionally, an absorber for absorbing ink may be placed inside the groove portion 10*a*.

Each rib 10*b* extends in the Y direction with its tip protruding into the groove portion 10*a*, and supports the printing medium S being printed, from the back. The ribs 10*b* facing each other across the groove portion 10*a* form a pair, and such pairs are arranged in the X direction at predetermined intervals. The lengths of the two ribs 10*b* facing each other across the groove portion 10*a* do not have to be the same.

In such a configuration, according to the arrangement of the ribs 10*b*, small waves are formed in the printing medium S pressed against the platen 10 by being nipped between the upstream roller 11 and the pinch rollers 11*a*. The small waves according to the arrangement of the ribs 10*b* are purposely formed in the printing medium S being conveyed, so that the gap between the ejection port surface 30*a* of the printing head 30 and the printing medium S may stay in a predetermined range in order to prevent, for example, a contact between the ejection port surface 30*a* and the printing medium S and disturbance of an image caused by the contact.

In "borderless printing", the printing head 30 prints an image on an area a little larger than the actual size of the printing medium S. For example, to print a leading edge part of the printing medium S as shown in FIG. 5B, the printing head 30 ejects ink with the leading edge of the printing medium S being included in the ejection region. Then, the ink ejected inside the leading edge of the printing medium S is absorbed by the printing medium S, but the ink ejected outside the leading edge is collected in the groove portion 10*a*. Similarly, to print a tailing edge portion of the printing medium S, the ink ejected outside the tailing edge of the printing medium S is collected in the groove portion 10*a*, and to print the center portion of the printing medium S, the ink ejected outside the side edges of the printing medium S is collected in the groove portion 10*a*.

In this way, in the "borderless printing" mode, the ink ejected outside the edge portions of the printing medium S is mostly collected in the groove portion 10*a*. However, part of the ink that is not absorbed by the printing medium S may become a mist, floating and adhering to a region other than the groove portion 10*a*. Particularly in a case of the platen 10 having the structure of the present embodiment, a large amount of ink is likely to adhere to the ribs 10*b* protruding into the groove portion 10*a*. The ink adhering to the ribs 10*b* is absorbed by the back surface of a new printing medium S that is conveyed next, contaminating the printing medium S. In other words, in a case where the printing apparatus 1 has the configuration of the present embodiment, it is necessary to appropriately clean the pairs of the ribs 10*b* that face each other across the groove portion 10*a*.

A cleaning mode of the present embodiment is described below.

Figure 6:
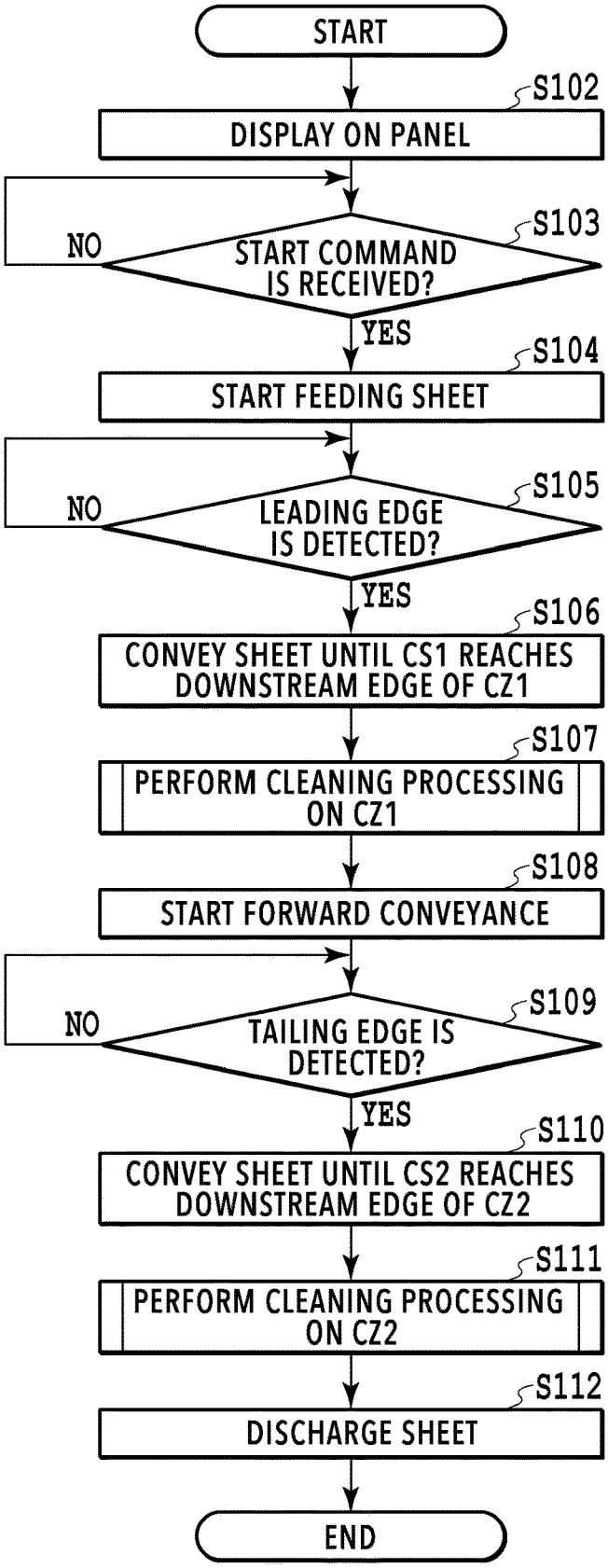
FIG. 6 is a flowchart illustrating the steps of processing performed in a first embodiment.

FIG. 6 is a flowchart illustrating the steps of processing performed by the controller 205 of the present embodiment in a cleaning mode. The controller 205 performs this processing as instructed by the CPU 201 according to the programs stored in the ROM 202, using the RAM 203 as a work area. This processing may be started by a user selecting a cleaning mode with the operation keys 6 or may be started through a printer driver of a host apparatus connected externally.

After this processing is started, first in S102, the controller 205 displays on the display panel 5 how to prepare for the cleaning mode.

Figure 7B:
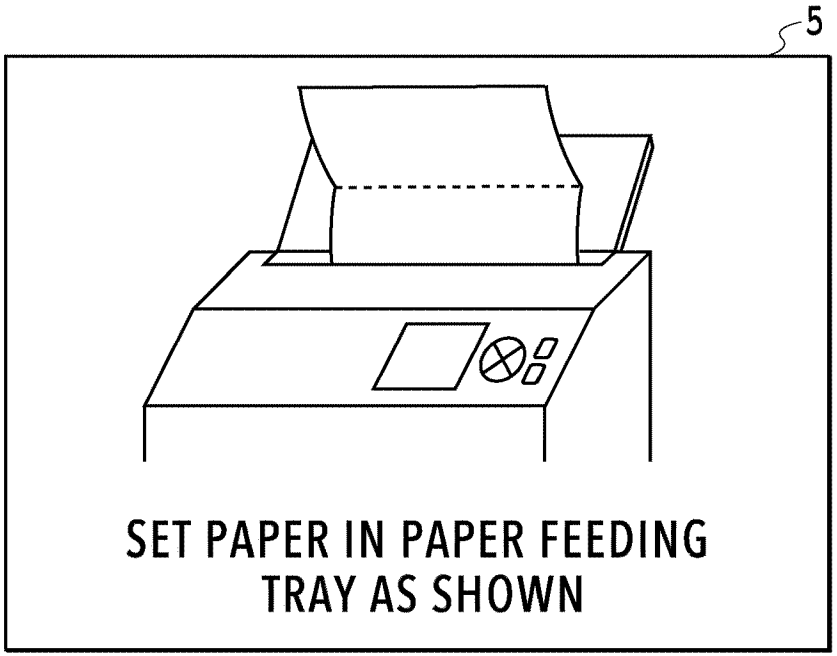
FIGS. 7A and 7B are diagrams showing an example of what is displayed on a display panel.
Figure 7A:
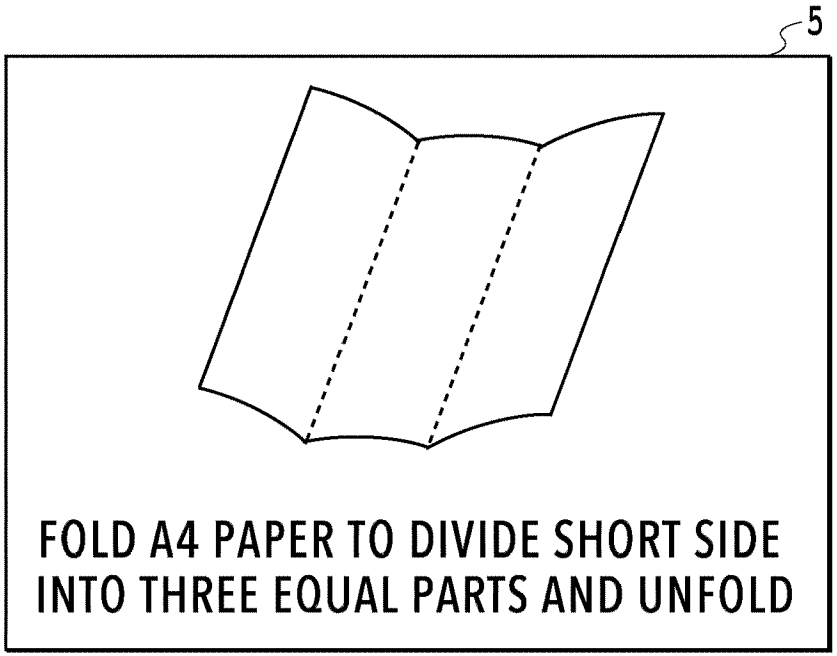

FIGS. 7A and 7B are diagrams showing how to prepare for the cleaning mode displayed on the display panel 5 in S102. FIG. 7A shows how to make a cleaning sheet to be used for the cleaning mode. FIG. 7B shows how to set the cleaning sheet made. FIGS. 7A and 7B may be alternately displayed automatically, or may be switched by a user pressing the operation panel. A user first prepares a cleaning sheet S1 according to FIG. 7A.

Figure 8:
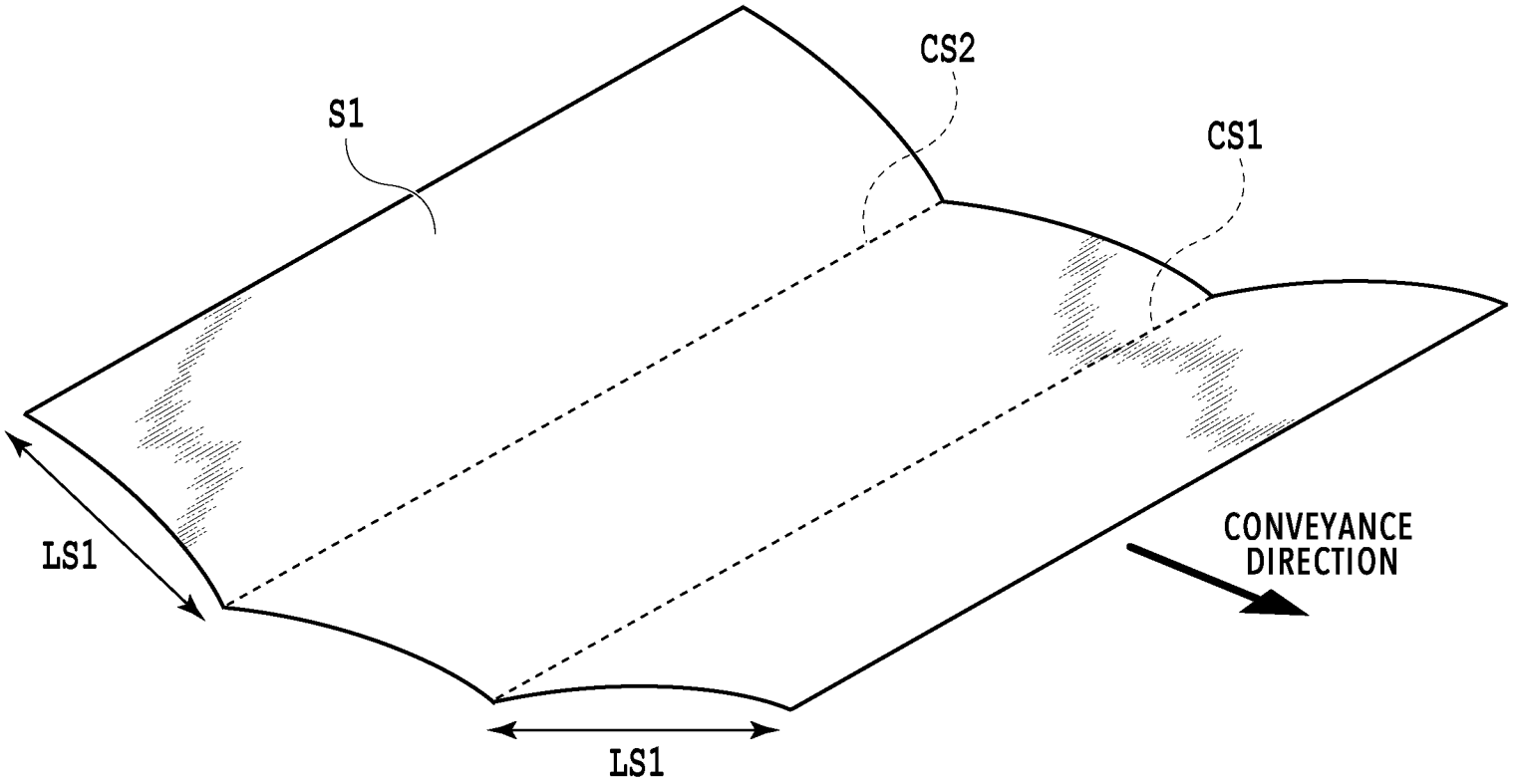
FIG. 8 is a diagram illustrating a cleaning sheet of the first embodiment.

FIG. 8 is a diagram illustrating the cleaning sheet S1 of the present embodiment. The cleaning sheet S1 of the present embodiment can be made using an A4-size sheet of plain paper usable for the regular printing operation. While checking on the display of FIG. 7A, a user makes the cleaning sheet S1 by folding a A4-size sheet of plain paper so that its short side may be divided into three equal parts and unfolding the sheet. In the cleaning sheet S1 thus made, two creases CS1, CS2 are formed at an equal interval LS1.

After making the cleaning sheet S1, the user follows the display of FIG. 7B and sets the cleaning sheet S1 into the paper feed tray 3 of the printing apparatus 1. Specifically, the user sets the cleaning sheet S1 so that the vertices of the creases CS1, CS2 may extend in the X direction and face the platen 10. After that, the user instructs to start the cleaning mode using the operation keys 6. Hereinafter, the crease situated downstream in the conveyance direction (the leading side) is referred to as a first crease CS1, and the crease situated upstream in the conveyance direction (the tailing side) is referred to as a second crease CS2.

Back to FIG. 6, upon receipt of a command to start the cleaning mode in S103, the controller 205 proceeds to S104 to start a paper feeding operation in a similar manner to the regular printing operation. Specifically, the controller 205 drives the conveyance motor 13 through the conveyance motor driver 206 to convey the cleaning sheet S1 set in the paper feed tray 3 in the Y direction. Note that in the following description, conveyance in the same direction as the regular printing operation (the +Y direction) is referred to as forward conveyance, and conveyance in a direction opposite from the regular printing operation (the −Y direction) is referred to as backward conveyance.

Figure 9A:
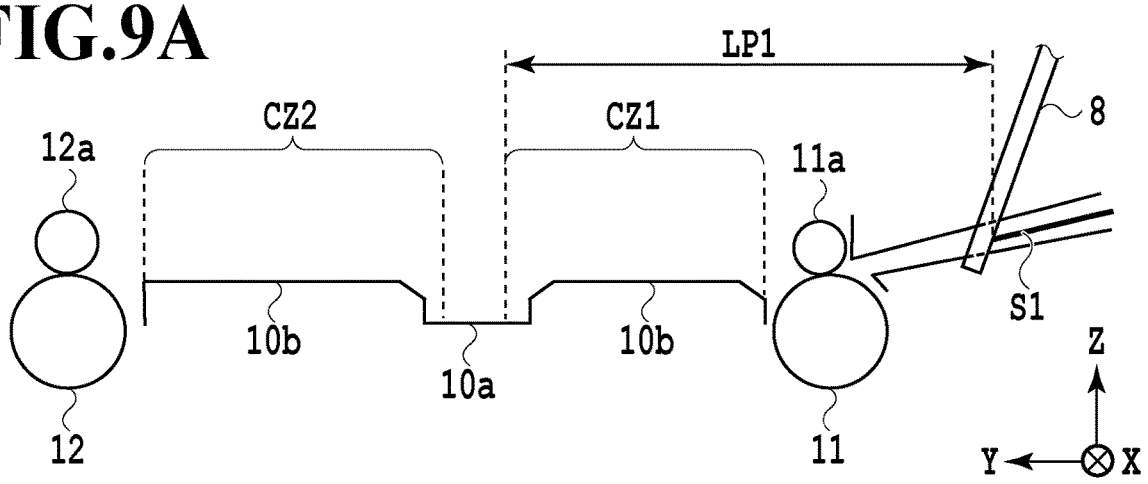
FIGS. 9A to 9C are diagrams showing the step of conveying the cleaning sheet according to the first embodiment.
Figure 9B:
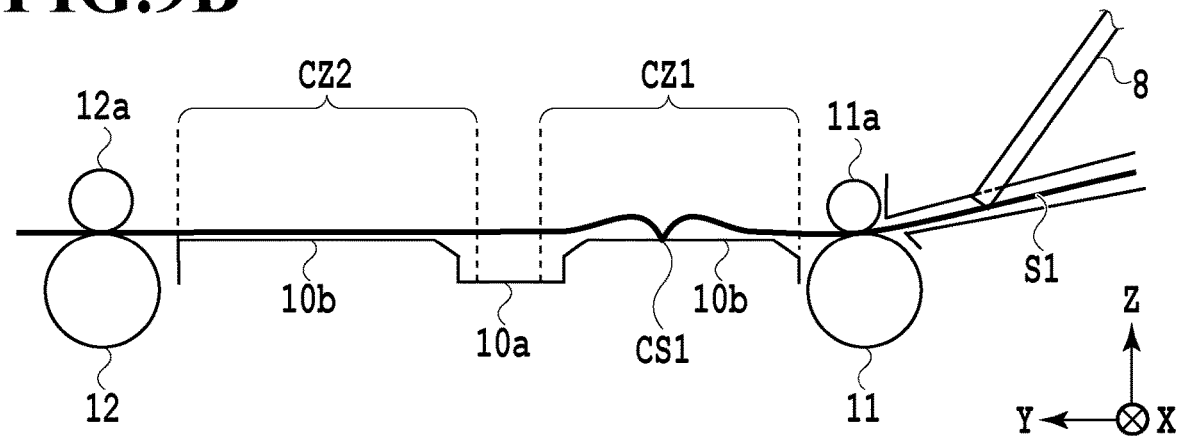
Figure 9C:
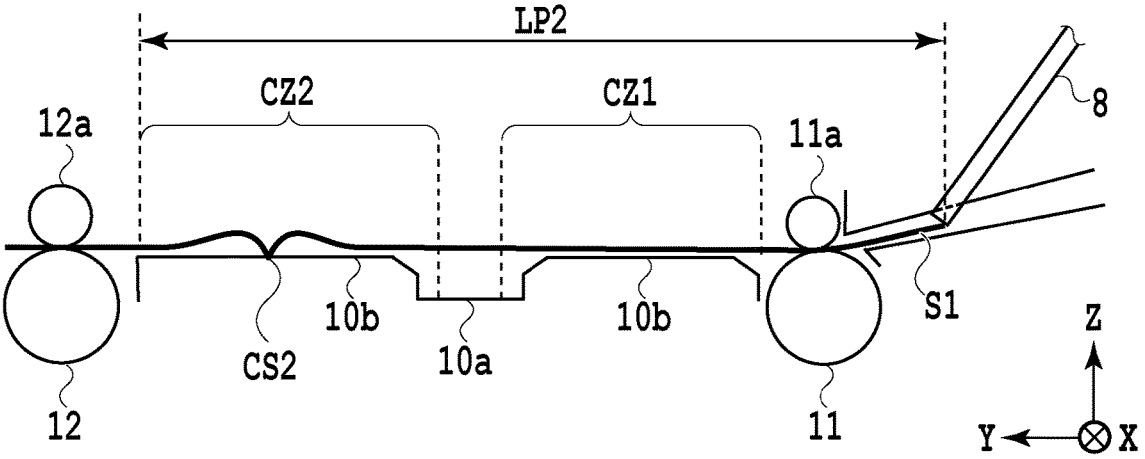

FIGS. 9A to 9C are diagrams showing the step of conveying the cleaning sheet according to the present embodiment. In the platen 10 in FIGS. 9A to 9C, a region which is upstream of the groove portion 10*a* is denoted as a first region CZ1, and a region downstream of the groove portion 10*a* is denoted as a second region CZ2. In the present embodiment, the first region CZ1 is defined by the length of the ribs 10*b* placed upstream of the groove portion 10*a*, and the second region CZ2 is defined by the length of the ribs 10*b* placed downstream of the groove portion 10*a*.

FIG. 9A shows a state where the leading edge of the cleaning sheet S1 has reached the edge sensor 8. The controller 205 can recognize that the cleaning sheet S1 has reached the edge sensor 8 because the leading edge of the cleaning sheet S1 comes into contact with and turns the lever of the edge sensor 8. The forward conveyance of the cleaning sheet S1 started in S104 of FIG. 6 is continued until the leading edge of the cleaning sheet S1 is detected as in FIG. 9A.

Back to FIG. 6, after recognizing the leading edge of the cleaning sheet S1 in S105, in S106 the controller 205 conveys the cleaning sheet S1 by a predetermined distance to align the first crease CS1 with the downstream edge of the first region CZ1. With LP1 being the distance from the edge sensor 8 to the downstream edge of the first region CZ1 (FIG. 9A) and LS1 being the distance from the leading edge of the cleaning sheet S1 to the first crease CS1 (see FIG. 8), both of these distances being known values, the distance of the conveyance in S106 is LP1+LS1. At the point the conveyance in S106 is completed, the first region CZ1 has been wiped once by the first crease CS1.

In S107, the controller 205 performs cleaning processing on the first region CZ1. Specifically, the controller 205 repeats the following operations alternately N times (N being an integer of 1 or greater): conveying the cleaning sheet S1 backward (in the −Y direction) by the distance corresponding to the first region CZ1 and conveying the cleaning sheet S1 forward (in the +Y direction) by the same distance. Consequently, the first crease CS1 of the cleaning sheet S1 has moved back and forth N times between the downstream edge and the upstream edge of the first region CZ1.

FIG. 9B shows how the cleaning processing is performed on the first region CZ1 in S107. The first crease CS1 of the cleaning sheet S1 moves back and forth within the first region CZ1 in the ±Y directions while being in contact with the ribs 10*b*. The first crease CS1 thus acts as a cleaning wiper, wiping off the ink adhering to the ribs 10*b* in the first region CZ1.

Back to the flowchart in FIG. 6, in S108 the controller 205 starts conveying the cleaning sheet S1 forward. Then, after recognizing the tailing edge of the cleaning sheet S1 (S109), the controller 205 proceeds to S110 to convey the cleaning sheet S1 further until the second crease CS2 is located at the downstream edge of the second region CZ2. With LP2 being the distance from the edge sensor 8 to the downstream edge of the second region CZ2 (see FIG. 9C) and LS1 being the distance from the tailing edge of the cleaning sheet S1 to the second crease CS2 (see FIG. 8), the distance of the conveyance in S110 is LP2-LS1. At the point the conveyance in S110 is completed, the second region CZ2 has been wiped once by the second crease CS2.

In S111, the controller 205 performs cleaning processing on the second region CZ2. Specifically, the controller 205 repeats the following operations alternately M times (M being an integer of 1 or greater): conveying the cleaning sheet S1 backward (in the −Y direction) by the distance corresponding to the second region CZ2 and conveying the cleaning sheet S1 forward (in the +Y direction) by the same distance. Consequently, the second crease CS2 of the cleaning sheet S1 has moved back and forth M times between the downstream edge and the upstream edge of the second region CZ2.

FIG. 9C shows how the cleaning processing is performed on the second region CZ2 in S111. The second crease CS2 of the cleaning sheet S1 moves back and forth within the second region CZ2 in the ±Y directions while being in contact with the ribs 10*b*. The second crease CS2 thus acts as a cleaning wiper, wiping off the ink adhering to the ribs 10*b* in the second region CZ2.

Back to the flowchart in FIG. 6, in S112 the controller 205 discharges the cleaning sheet S1 to the paper discharge unit 4. This processing thus ends.

In the flowchart described above, after the cleaning processing on the first region CZ1 is performed (S107), the cleaning processing on the second region CZ2 (S111) is performed with the ink-absorbed first crease CS1 having been moved downstream of the second region CZ2. Thus, there are no concerns that the first crease CS1 which has absorbed ink touches or contaminates the second region CZ2 which has been cleaned, and therefore the cleaning effect is not harmed.

With the cleaning mode of the present embodiment described above, the ribs 10*b* in the first region CZ1 are wiped by the first crease CS1 moving back and forth, and the ribs 10*b* in the second region are wiped by the second crease CS2 moving back and forth. In other words, the two creases formed in the cleaning sheet S1 are used for the respective corresponding regions. Thus, compared to a conventional configuration in which cleaning processing is performed using the same crease for the entire region of the platen, the configuration according to the present embodiment can make more efficient use of a single cleaning sheet, further enhancing the cleaning effect for the each of the regions.

In the above description, the positioning in S110 between the downstream edge of the second region CZ2 and the second crease CS2 is performed based on the tailing edge of the cleaning sheet S1 detected in S109. This is because using the tailing edge of the cleaning sheet S1 as a reference for the positioning between the second region CZ2 and the second crease CS2 makes the conveyance distance from the reference position small, and therefore can make conveyance error small. However, the above positioning can also be performed based on the leading edge of the cleaning sheet S1 detected in S103. In this case, in S110, the controller 205 may convey the cleaning sheet S1 by a distance corresponding to LP2+LS1+LS1 from the position at which the leading edge of the cleaning sheet S1 is detected in S103. This approach is effective in a case where, for example, the edge sensor 8 is located more downstream than in the above embodiment and cannot detect the tailing edge of the cleaning sheet S1 during cleaning processing. This approach is also effective for a configuration where the edge sensor 8 is locked in the backward conveyance of the cleaning sheet S1 after the cleaning sheet S1 passes the edge sensor 8.

In the present embodiment, it is concerned that certain deviations and errors are included in the positions of the creases formed manually by a user and in the ranges in which the creases move relative to the extension ranges of the ribs 10*b*. Thus, the sizes of the first region CZ1 and the second region CZ2 in the Y direction are preferably set somewhat larger than the extension ranges of the ribs 10*b* in advance.

Also, in the present embodiment, the number of times N the first crease CS1 moves back and forth in the first region CZ1 and the number of times M the second crease CS2 moves back and forth in the second region CZ2 may be variously modified depending on factors such as the length of the ribs 10*b* and the ink absorbing ability of the cleaning sheet S1. It goes without saying that N and M may be set to equal values or different values.

Second Embodiment

Like the first embodiment, a second embodiment uses the printing apparatus 1 described in FIGS. 1 to 5B. In the first embodiment, cleaning processing on the second region CZ2 is performed after cleaning processing on the first region CZ1 is completed. By contrast, in the present embodiment, the cleaning processing on the first region CZ1 and the cleaning processing on the second region CZ2 are performed simultaneously in parallel. Thus, in the present embodiment, the lengths of the first region CZ1 and the second region CZ2 are defined so that the ribs 10*b* in the first region and the ribs 10*b* in the second region can be satisfactorily wiped by the common movement of two creases. Thus, the regions are set not to sizes defined according to the length of the ribs 10*b* included in the region like in the first embodiment, but to equal sizes so that the longer ribs 10*b* are completely included in the regions.

Figure 10:
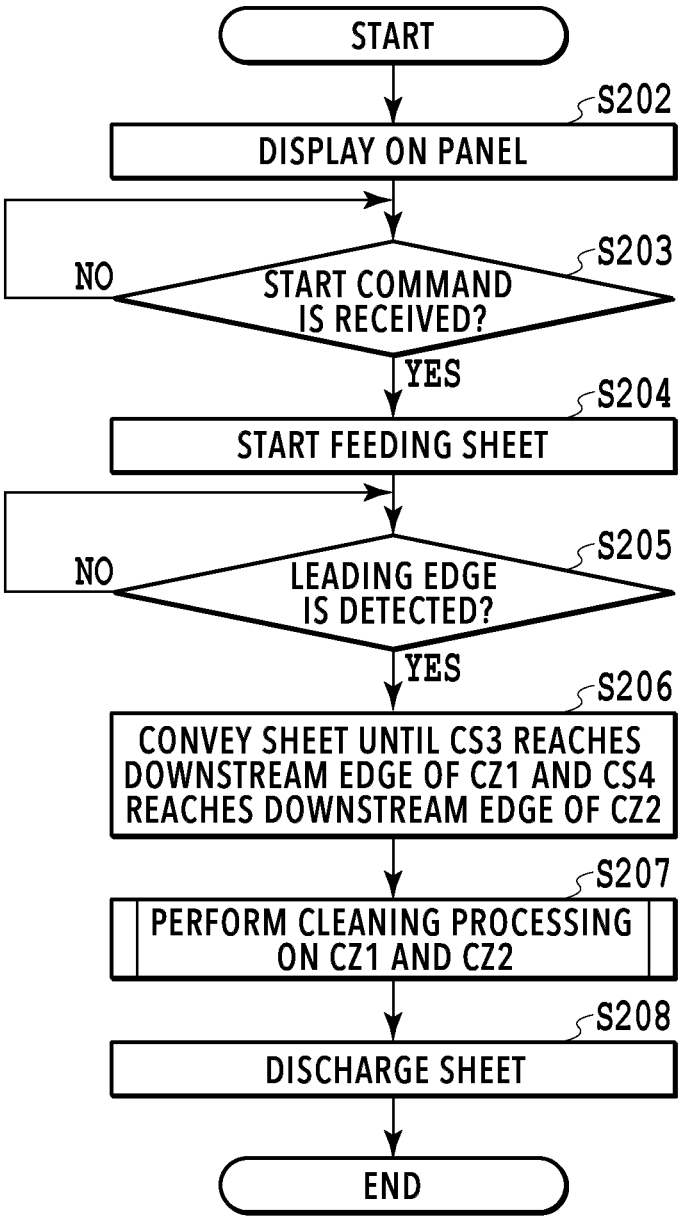
FIG. 10 is a flowchart illustrating the steps of processing performed in a second embodiment.

FIG. 10 is a flowchart illustrating the steps of processing performed by the controller 205 of the present embodiment in a cleaning mode of the present embodiment. The controller 205 performs this processing as instructed by the CPU 201 according to the programs stored in the ROM 202, using the RAM 203 as a work area. This processing may be started by a user selecting a cleaning mode with the operation keys 6 or may be started through a printer driver of a host apparatus connected externally.

Once this processing is started, first in S202, the controller 205 displays how to prepare for the cleaning mode on the display panel 5.

Figure 11:
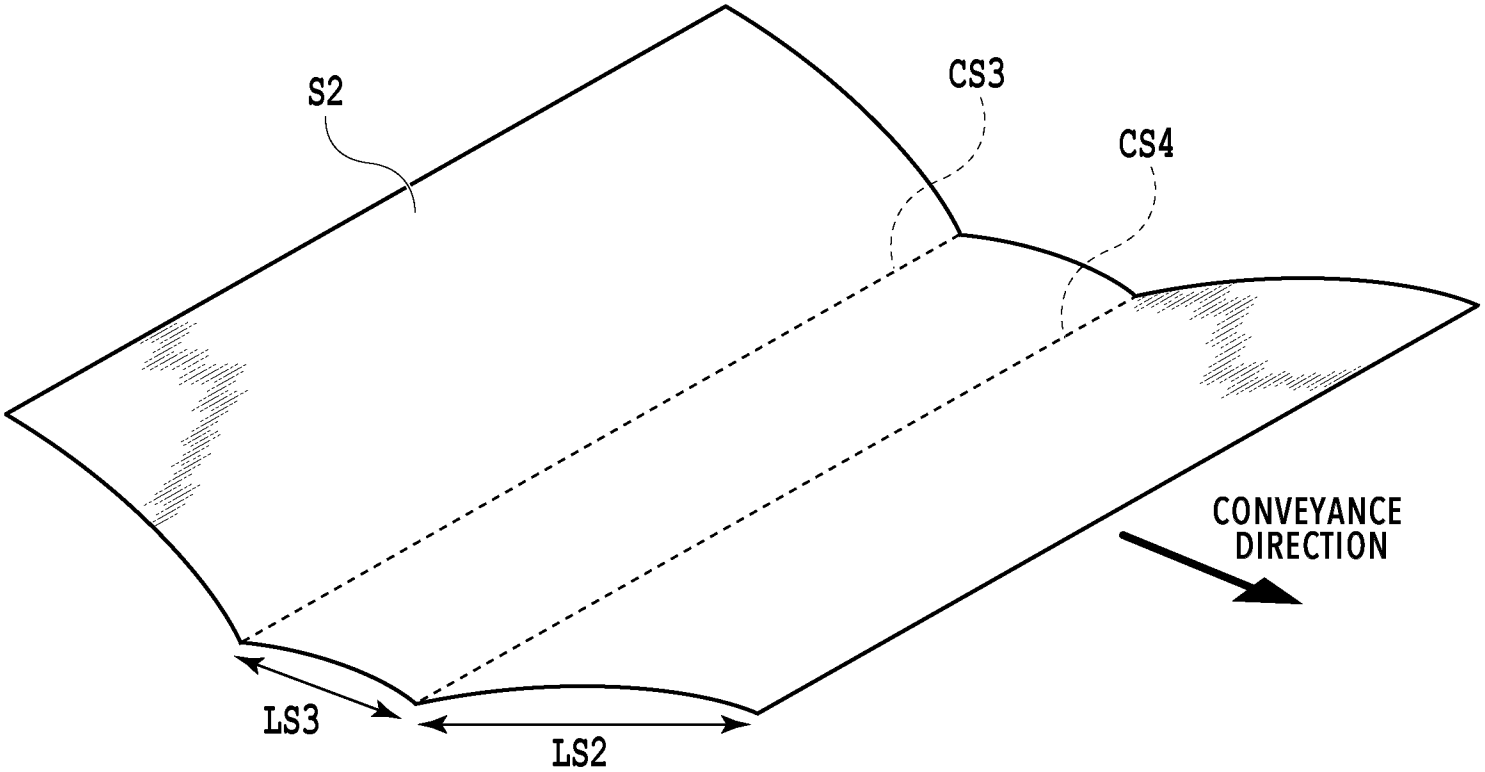
FIG. 11 is a diagram illustrating a cleaning sheet of the second embodiment.

FIG. 11 is a diagram illustrating a cleaning sheet S2 used in the present embodiment. In the present embodiment, a third crease CS3 for cleaning the first region CZ1 and a fourth crease CS4 for cleaning the second region CZ2 are formed with an interval LS3 interposed therebetween, the interval LS3 corresponding to the distance between the first region CZ1 and the second region CZ2 in the conveyance direction. In FIG. 11, the fourth crease CS4 is formed at a position away from the leading edge by the distance LS2, and the third crease CS3 is formed at a position away from the fourth crease CS4 by the distance LS3. The cleaning sheet S2 of the present embodiment can be made using plain paper usable for the regular printing operation, as well.

After making the cleaning sheet S2, the user sets the cleaning sheet S2 into the paper feed tray 3 of the printing apparatus 1. Specifically, the user sets the cleaning sheet S2 so that the vertices of the third and fourth creases CS3, CS4 face the platen 10. After that, the user instructs to start the cleaning mode using the operation keys 6.

Back to FIG. 10, upon receipt of a command to start the cleaning mode in S203, the controller 205 proceeds to S204 to start a paper feeding operation in a similar manner to the regular printing operation.

Figure 12A:
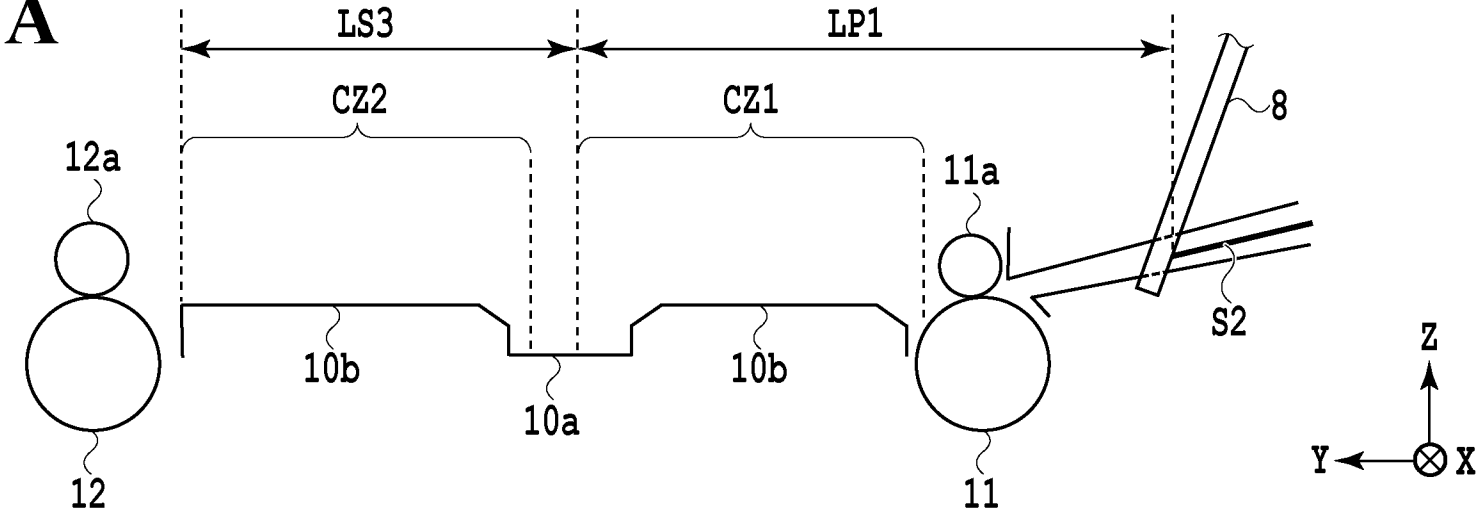
FIGS. 12A and 12B are diagrams showing the step of conveying the cleaning sheet according to the second embodiment.
Figure 12B:
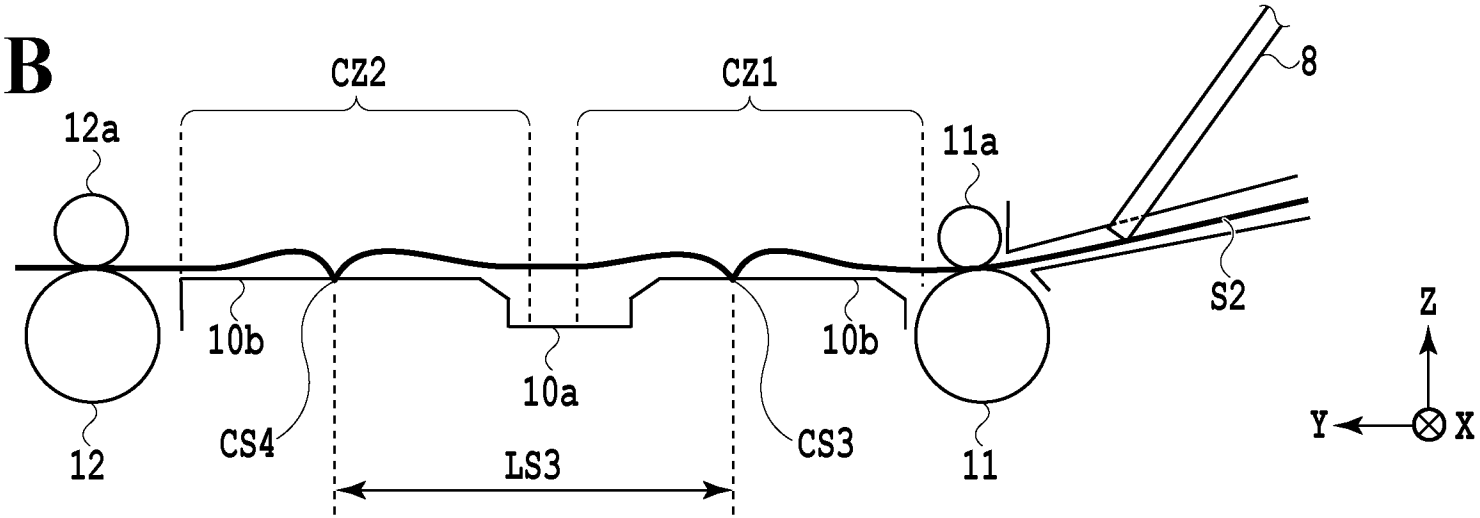

FIGS. 12A and 12B are diagrams showing the step of conveying the cleaning sheet according to the present embodiment. FIG. 12A shows a state where the leading edge of the cleaning sheet S2 has reached the edge sensor 8. The controller 205 can know that the cleaning sheet S2 has reached the edge sensor 8 because the leading edge of the cleaning sheet S2 comes into contact with and turns the lever of the edge sensor 8.

Back to FIG. 10, after recognizing the leading edge of the cleaning sheet S2, in S206 the controller 205 conveys the cleaning sheet S2 by a predetermined distance. By this conveyance, the third crease CS3 is aligned with the downstream edge of the first region CZ1, and the fourth crease CS4 is aligned with the downstream edge of the second region CZ2. With LP1 being the distance from the edge sensor 8 to the downstream edge of the first region CZ1 (see FIG. 12A) and LS3 being the distance from the downstream edge of the first region CZ1 and the downstream edge of the second region CZ2 (see FIG. 12A), the distance of the conveyance in S206 is LP1+LS3. At the point the conveyance in S206 is completed, the first region CZ1 has been wiped once by the third crease CS3, and the second region CZ2 has been wiped once by the fourth crease CS4.

In S207, the controller 205 performs cleaning processing on the first region CZ1 and cleaning processing on the second region CZ2 in parallel. Specifically, the controller 205 repeats the following operations alternately K times (K being an integer of 1 or greater): conveying the cleaning sheet S2 backward (in the −Y direction) by the distance corresponding to each of the first region CZ1 and the second region CZ2 and conveying the cleaning sheet S2 forward (in the +Y direction) by the same distance. Consequently, the third crease CS3 of the cleaning sheet S2 has moved back and forth K times between the downstream edge and the upstream edge of the first region CZ1, and the fourth crease CS4 of the cleaning sheet S2 has moved back and forth K times between the downstream edge and the upstream edge of the second region CZ2.

FIG. 12B shows how the cleaning processing is performed on each of the first region CZ1 and the second region CZ2 in S207. The third crease CS3 of the cleaning sheet S2 moves back and forth within the first region CZ1 while being in contact with the ribs 10*b* in the first region CZ1, and the fourth crease CS4 of the cleaning sheet S2 moves back and forth within the second region CZ2 while being in contact with the ribs 10*b* in the second region CZ2. Thereby, ink adhering to the ribs 10*b* in the first region CZ1 and to the ribs 10*b* in the second region CZ2 are wiped off simultaneously in parallel. The number of times K the third crease CS3 and the fourth crease CS4 move back and forth may be variously modified depending on factors such as the length of the ribs 10*b*, the ink absorbing ability of the cleaning sheet S2, and a period of time since the previous cleaning processing.

Back to the flowchart in FIG. 10, in S208 the controller 205 discharges the cleaning sheet S2 to the paper discharge unit 4. This processing thus ends.

With the cleaning mode of the present embodiment described above, the first region CZ1 and the second region CZ2 of the platen 10 are simultaneously wiped by the third crease CS3 and the fourth crease CS4, respectively, moving back and forth in parallel. As a result, the present embodiment achieves a similar cleaning effect to that achieved by the first embodiment, and can also finish the cleaning processing in a shorter period of time than the first embodiment.

Third Embodiment

The first and second embodiments describe methods for cleaning the platen 10 having the groove portion 10*a*, on the assumption that the printing apparatus performs "borderless printing." By contrast, a third embodiment describes a case of cleaning a flat platen in a printing apparatus that does not perform "borderless printing." The printing apparatus of the third embodiment has the same outer appearance and control configuration as those of the first and second embodiments depicted in FIGS. 1 and 4.

Figure 13:
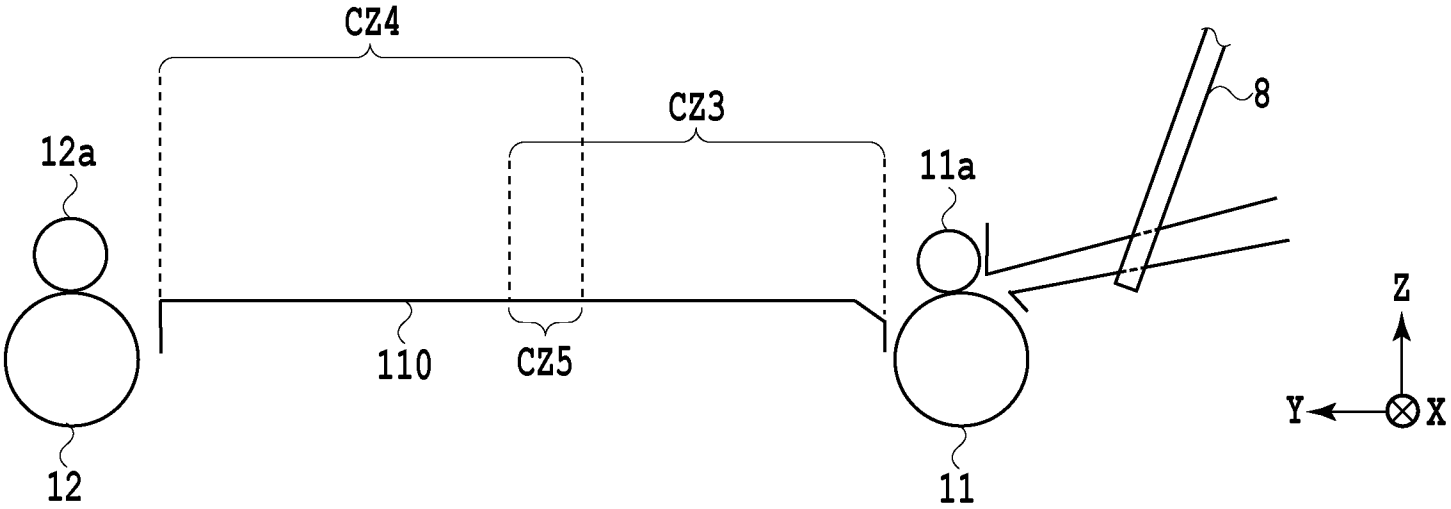
FIG. 13 is a diagram showing a conveyance path in a printing apparatus used in a third embodiment.

FIG. 13 is a diagram showing a conveyance path in the printing apparatus 1 used in the present embodiment. The upstream roller 11, the pinch rollers 11*a*, the downstream roller 12, the spurs 12*a*, and the edge sensor 8 have the same configurations as those in the above embodiments. A flat platen 110 that supports the printing medium S from below is placed between the roller pair formed by the upstream roller 11 and the pinch rollers 11*a* and the roller pair formed by the downstream roller 12 and the spurs 12*a*. In the printing apparatus 1 of the present embodiment, the size of the printing region of the printing head and the size of the platen 110 are longer in the Y direction than usual in order to be able to print general documents at high speed.

In the present embodiment, an upstream region CZ3 and a downstream region CZ4 are set on the flat platen 110 with an overlap region CZ5 being included. The present embodiment performs the cleaning processing in the same manner as the first and second embodiments by regarding the upstream region CZ3 as the first region CZ1 in the above embodiments and the downstream region CZ4 as the second region CZ2 in the above embodiments.

For example, in a case where the first embodiment is employed, the cleaning processing is performed according to the flowchart depicted in FIG. 6. As a result, the upstream region CZ3 is wiped by the first crease CS1 moving back and forth. After that, the downstream region CZ4 is wiped by the second crease CS2 moving back and forth.

In a case where the second embodiment is employed, the cleaning processing is performed according to the flowchart depicted in FIG. 10. As a result, the upstream region CZ3 and the downstream region CZ4 are simultaneously wiped by the third crease CS3 and the fourth crease CS4, respectively, moving back and forth in parallel.

Irrespective of which of the embodiments is employed, the overlap region CZ5 is wiped doubly by the two creases (CS1 and CS2 or CS3 and CS4). By being provided with such overlap region CZ5, the present embodiment can wipe ink adhering to the platen 110 without leaving any, even in a case where, for example, there are deviations in the creases in a cleaning sheet, conveyance error, or error in the detection by the edge sensor 8. Thus, the overlap region CZ5 is preferably set to a necessary and sufficient size with the above-described various errors taken into account.

Other Embodiments

Methods for making the cleaning sheets described in the first and second embodiments are not limited to the ones described in FIGS. 8 and 11. The orientations and positions of the creases in a cleaning sheet may be set appropriately according to factors such as the structure and size of the platen in the printing apparatus. To clarify the positions of the creases, a step of printing the positions of creases on a sheet of paper to be used as a cleaning sheet may be performed before the flowchart depicted in FIG. 6 or 10 is executed. However, there are concerns in this case that the positions of the creases may become unclear in a case where ink on the platen adheres to this sheet of paper. Thus, in such a case, it is preferable to guide the user to make the cleaning sheet so that the printed side will be valley folded. Also, although a user makes a cleaning sheet by folding a sheet of plain paper in the above embodiments, a dedicated cleaning sheet may be prepared in advance.

In the above embodiments, the platen is divided into an upstream region and a downstream region, and two creases are formed to correspond to these two regions on a one-to-one basis. Alternatively, there may be more regions in the platen and more creases. For example, an upstream region, a midstream region, and a downstream region may be set as regions of the platen, and a cleaning sheet may be made which has three creases to correspond to these three regions on a one-to-one basis. Also, two or more creases may correspond to each region. In this case, after the first one of the creases moves and wipes a certain region multiple times, the next crease which has yet to absorb any ink moves and wipes the same region multiple times. This way, the wiping effect can be enhanced even more.

At any rate, any configuration may be employed as long as a plurality of regions are set on the platen in the conveyance direction, one or more creases are formed to correspond to each of these regions, and a wiping operation is performed using these creases.

Embodiment(s) of the present invention can also be realized by a computer of a system or apparatus that reads out and executes computer executable instructions (e.g., one or more programs) printed on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026161 filed Feb. 19, 2020, which is hereby incorporated by reference wherein in its entirety.

What is claimed is:

1. A printing apparatus comprising:

a conveyance unit capable of conveying a printing medium in a conveyance direction;

a printing head configured to eject ink toward a printing medium that is conveyed in the conveyance direction by the conveyance unit; and a platen having a groove portion extending in a direction that intersects with the conveyance direction, the platen facing the printing head and configured to support a printing medium;

wherein in the conveyance direction, the platen has a first region upstream of the groove portion, and a second region downstream of the groove portion, and wherein in a case of cleaning the platen by a cleaning sheet in which a first crease and a second crease upstream of the first crease in the conveyance direction are formed, the conveyance unit conveys the cleaning sheet so that the cleaning sheet moves back and forth in the conveyance direction with the first crease in contact with the first region, and thereafter moves back and forth with the second crease in contact with the second region.

2. The printing apparatus according to claim 1, further comprising an edge sensor capable of detecting passage of a leading edge and a tailing edge of the cleaning sheet, wherein the conveyance unit moves the first crease back and forth in the first region based on a position where the edge sensor detects the leading edge of the cleaning sheet and the conveyance unit moves the second crease back and forth in the second region based on a position where the edge sensor detects the tailing edge of the cleaning sheet.

3. The printing apparatus according to claim 1, wherein the cleaning sheet is a sheet of paper usable as a printing medium on which to print an image, and the first crease and the second crease are formed by a user folding the sheet of paper.

4. The printing apparatus according to claim 1, wherein the conveyance unit conveys the cleaning sheet using a roller placed upstream of the platen and a roller placed downstream of the platen in the conveyance direction.

5. A printing apparatus comprising:

a conveyance unit capable of conveying a printing medium in a conveyance direction;

a printing head configured to eject ink toward a printing medium that is conveyed in the conveyance direction by the conveyance unit;

a platen having a first region and a second region at different positions in the conveyance direction, facing the printing head and configured to support a printing medium; and a control unit configured to, in a case of cleaning the platen, cause the conveyance unit to move a cleaning sheet in which a first crease and a second crease are formed back and forth in the conveyance direction so that the first crease contacts the first region and the second crease contacts the second region, wherein the platen has a groove portion extending in a direction that intersects with the conveyance direction, and in the conveyance direction, the first region is an upstream region relative to the groove portion, and the second region is a downstream region relative to the groove portion.

6. The printing apparatus according to claim 5, wherein the conveyance unit conveys the cleaning sheet so that the back and forth movement of the cleaning sheet with the first crease in contact with the first region and the back and forth movement of the cleaning sheet with the second crease in contact with the second region are performed simultaneously in parallel.

7. The printing apparatus according to claim 5, wherein a plurality of ribs are placed in the first region and the second region in such a manner as to extend in the conveyance direction and face each other across the groove portion.

* * * * *